United States Patent [19]

Azuma et al.

[11] 3,982,157

[45] Sept. 21, 1976

[54] EQUIPMENT FOR SPOUTING POWDER OR FLUID HAVING MECHANISM FOR PREVENTING ELECTRIC SHOCK

[75] Inventors: Kanae Azuma; Minoru Ochiai, both of Ashikaga, Japan

[73] Assignee: Kohkoku Chemical Industry Co., Ltd., Tokyo, Japan

[22] Filed: Mar. 11, 1975

[21] Appl. No.: 557,303

[30] Foreign Application Priority Data

| | | |
|---|---|---|
| Mar. 15, 1974 | Japan | 49-29805 |
| June 5, 1974 | Japan | 49-63685 |
| June 12, 1974 | Japan | 49-69040 |

[52] U.S. Cl. ..... 317/2 J

[51] Int. Cl.[2] ..... H05F 1/02

[58] Field of Search ..... 317/2 J; 174/1, 5 R

[56] References Cited

UNITED STATES PATENTS

| | | | |
|---|---|---|---|
| 2,603,299 | 7/1952 | Mapes | 317/2 J X |
| 3,121,187 | 2/1964 | Hartsock et al. | 317/2 J |

*Primary Examiner*—R. N Envall, Jr.

*Attorney, Agent, or Firm*—Toren, McGeady and Stanger

[57] ABSTRACT

Apparatus for spouting powder or fluid and including means for preventing operational problems caused by static electricity without requiring grounding devices is formed with a spout tube embodying therein a nozzle and defining a flow passage through which the powder or fluid flows. A transport tube through which the powder or fluid moves to the spout tube is provided and a main body is arranged to contain the powder or fluid from which it is delivered to the transport tube. The invention particularly includes a projecting electricity-eliminating member composed of material having volume resistivity of $10^8$ Ω-cm or less. The electricity-eliminating member is placed in the flow passage facing the flow layer of the powder or fluid flowing through the device and is electrostatically connected to the main body. The electricity-eliminating member is shaped in a particular configuration for eliminating static electricity developed during operation of the equipment without requiring grounding of the device.

18 Claims, 10 Drawing Figures

EQUIPMENT FOR SPOUTING POWDER OR FLUID HAVING MECHANISM FOR PREVENTING ELECTRIC SHOCK

BACKGROUND OF THE INVENTION

The present invention provides means for eliminating static electricity charged on the body of equipment for spouting powder or fluid. It will also provide a new technique for removing static electricity problems such as electric shock in case static electricity charged on the body of the equipment can not be made to leak by grounding.

Static electricity generated on this type of equipment is usually removable by merely grounding it with a long earth wire; but since the equipment is carried from one place to the other for its use, the grounding is impractical.

Another method employed to eliminate static electricity is to have a short earth wire connected to the equipment, leaving its tip to contact with a floor. But the earth wire becomes obstructive when the equipment is operated and when it is used inside the structure having a floor, the equipment does not work unless the floor is made of electrostatically conductive material. To ground the body of an operator handling the equipment, the volume resistivity of the soles of the footwear worn must be under $10^8\Omega$-cm. But the volume resistivity of the soles of footwear is generally over $10^8\Omega$-cm. It is therefore difficult to let static electricity flow through the body.

SUMMARY OF THE INVENTION

Generally, equipment to be used for spouting powder or fluid such as an agricultural chemicals sprayer, fire extinguisher, etc. are statically electrified objects. Such static electricity, unless properly eliminated, will flow through the operator's body, causing electric shock. The object of the present invention is to provide equipment for spouting powder or fluid with a novel technique for eliminating such static electricity problems.

Equipment for spouting powder or fluid according to the present invention comprises a spout tube 1, in which a nozzle is embodyed and through whose passage said powder or fluid moves and from said nozzle powder or fluid is spouted, a transport tube 4 through which said powder or fluid moves to said spout tube 1, and an equipment's main body 5 which contains said powder or fluid and which is connected to said transport tube 4. The equipment is constructed so as not to have its grounding device attached to its body.

A projecting electricity-eliminating member made of a material having volume resistivity under $10^8\Omega$-cm, which is facing the flow layer of powder or fluid is provided on a flow passage of the spout tube, and is connected electrostatically to the equipment main body.

Several embodiments are proposed for the projecting electricity-eliminating members which will cause leakage, neutralization, and discharge of electrical charge, thereby eliminating the static electricity of the equipment.

DETAILED DESCRIPTION OF THE INVENTION

Figure 1:
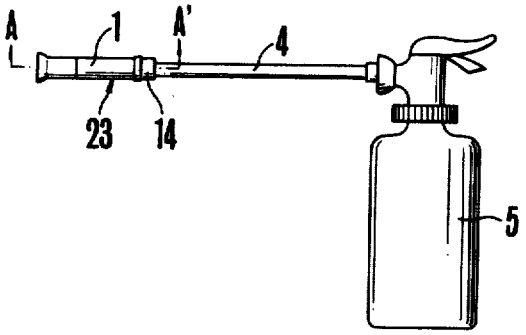
FIG. 1 is a schematic view showing an example of the present invention used as a fire extinguisher.
Figure 2:
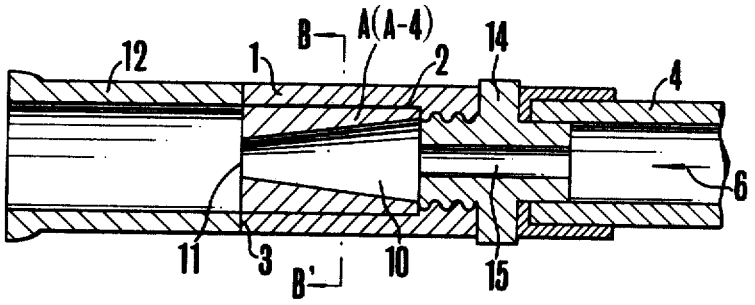
FIG. 2 is an enlarged cross-sectional view along line A—A in FIG. 1.
Figure 3:
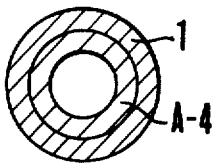
FIG. 3 is an enlarged cross-sectional view along line B—B in FIG. 2.

The present invention provides means for eliminating static electricity charged on the body of equipment when said equipment, constructed for spouting powder or fluid, generates static electricity through friction between the body of the equipment and the material contained therein, such as powder or fluid, moving from its vessel to the exterior through the pipe of the equipment. More particularly, this invention provides a novel technique for safely and ideally eliminating electrostatic troubles which develop in a case where the generated static electricity can not be made to leak out by means of grounding the equipment.

Generally, a device constructed for spouting powder or fluid is an electrostatically chargeable object, and therefore, static electricity builds up on such parts as the vessel and pipe of the equipment, while the static electricity of the reverse polarity builds up on the material contained therein, such as powder or fluid in this case moving toward the exterior of the device. Thus, the equipment must be made of metallic material and properly grounded to avoid electrification. However, it is impractical to ground equipment which is intended to be portable during use. Then, the equipment is under an electrostatically insulated condition. Consequently, on such equipment, a large amount of static electricity is generated and built up during its operations. When electrostatic charge reaches a saturated condition, a spark discharge occurs against a protruding object which is grounded nearby and causes ignition of combustible materials surrounding the object. When discharge takes place through a human body, the body is subjected to an electric shock.

The present inventors confirmed that the human body capable of accumulating approximately 100 PF of electrostatic charge will sense an electric shock when electrostatic charge of 3.5 – 4 KV (measured by an electrification voltage meter) built up on the body is released by electric discharge, and also, that the body is numb to the electrical shock caused by less electrification voltage value.

When equipment such as, for example, an agricultural chemical sprayer, a fire extinguisher, or a flame projector, is used in an electrostatically insulated condition, an electric shock is imparted to the person handling to equipment when the handler touches a grounded object. For example, a person spraying an agricultural chemical with a sprayer carried on his back will receive an electric shock by touching a grounded object, because the static electricity which has been built up on his body while he sprays with the sprayer leaks out. As for another example, a person who uses a manual type of fire extinguisher is subjected to an electric shock by touching a grounded object, as static electricity, which has been built up on his body as well as on the extinguisher itself while it is being used, is released through his body. These phenomena are well known in the art.

Since direct grounding is impractical for portable type equipment, especially constructed for spouting powder or fluid, a person carrying the equipment practically serves as a medium for grounding the equipment. However, he as well as the equipment will acquire an electrostatically insulated condition when either the soles of his footwear or material of the floor on which he stands has a volume resistivity of $10^8\Omega$-cm or higher.

Static electricity generated on such equipment can be released by merely connecting a long earth wire of which one end is connected to the equipment and the other to a grounded object.

However, the equipment is usually portable and carried when used. Especially when a fire extinguisher and like equipment is used in an emergency, it could not be handled quickly if it were equipped with an earth wire. This inconvenience makes it practically impossible to connect an earth wire. There is another method which can be employed. That is to connect a short earth wire of which one end is connected to the equipment and the other left free so as to have it freely contact with the floor surface. However, an unavoidable drawback of this method is that the earth wire even if short in length creates an obstacle when the equipment is carried or used. To have this method workable, the effective use of it requires that the material forming the floor or other surfact coming into contact with the wire be electrostatically conductive. In case the floor is made of insulating materials such as, polyvinyl chloride, tile or synthetic textile carpet, earthing is not possible and therefore this method does not work. To ground the body of a person handling the equipment, the volume resistivity of the soles of the footwear worn by the person must be under $10^8\Omega$-cm. Since the volume resistivity of footwear is generally over $10^8\Omega$-cm and it is difficult to ground static electricity through the feet, these circumstances made it very difficult to protect the equipment for spouting powder or fluid and the person handling it from electrostatic difficulties such as electrification and electric shock.

In view of the above mentioned facts, the present inventors thoroughly studied a technique to eliminate electrostatic difficulties without providing equipment with a grounding wire. And, as a result of this study, they confirmed the fact that the powder or fluid itself is electrically charged through the friction between powder or fluid and the vessel wall, when powder or fluid is moving and spouted, and at the same time, the electrical charge of reverse polarity thereto is given to and stored on the spouting equipment. Also they confirmed the phenomenon that, in case an insulated electric conductor storing generated electricity and having a sharp pointed end contacts the powder or fluid charged with reverse polarity, neutralization of electric charge occurs through electric discharge on the sharp pointed end, and they found that if the surface of an electric conductor storing static electricity contacts with powder or fluid charged with reverse polarity to the static electricity of the electric conductor, the static electricity charged on the conductor is neutralized on the contacted area by the static electricity charged on the powder or fluid. These facts led to the present invention.

Equipment for spouting powder or fluid according to the present invention comprises a spout tube 1 embodying a nozzle through whose passage said powder or fluid moves and from which powder or fluid is spouted, a transport tube 4 through which said powder or fluid moves to said spout tube 1, and an equipment main body 5, which contains said powder or fluid and which is connected to said transport tube 4.

During normal working condition of the equipment, powder or fluid contained in the equipment main body 5 is forced to flow by high pressure, such as, carbonic acid gas pressure into the transport tube 4, and through the transport tube 4, into and through the spout tube 1, and finally to the nozzle 3 of the spout tube 1 from which the powder or fluid is emitted. The equipment is constructed so as not to have its grounding device attached to its body. And it has the following characteristics particularly for eliminating static electricity.

A projecting electricity-eliminating member composed of a material having volume resistivity of $10^8\Omega$-cm or less, and facing the flow layer of powder or fluid which passes through the flow passage 2, is placed on the flow passage 2 of the spout tube 1. The projecting member A is electrostatically connected to the equipment main body 5.

Various embodiments of the projecting electricity-eliminating member A are proposed in the present invention, as follows.

Figure 4:
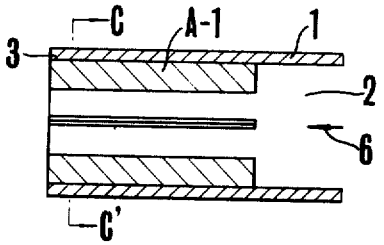
FIGS. 4, 5, 6, 7 and 8 are cross-sectional views illustrating embodiments of the contour of a projecting member for removing electricity used in the present invention.
Figure 5:
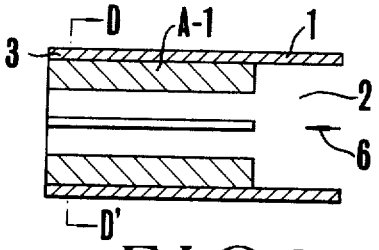
Figure 6:
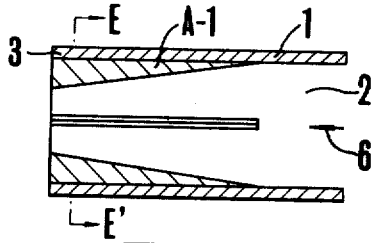
Figure 7:
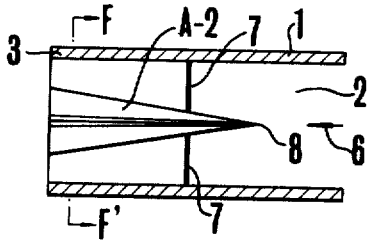
Figure 8:
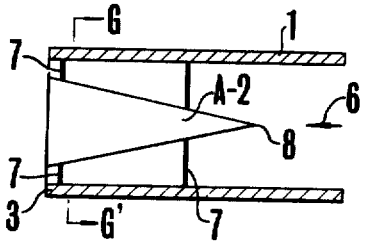
Figure 9:
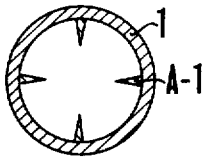
FIGS. 9, 10, 11, 12 and 13 are cross-sectional views respectively along line C—C in FIG. 4, along line D—D in FIG. 5, along line E—E in FIG. 6, along line F—F in FIG. 7, and along line G—G in FIG. 8.
Figure 10:
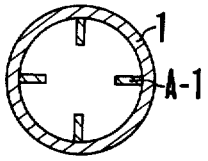
Figure 11:
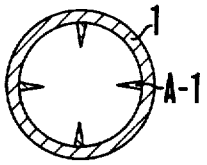
Figure 12:
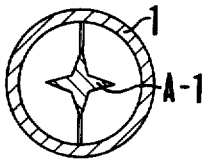
Figure 13:
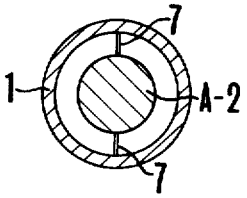
Figure 14:
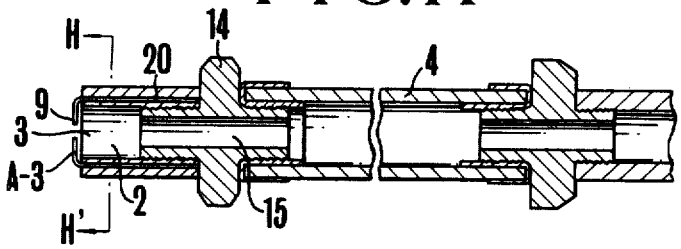
FIGS. 14, 16, 19, 20, 21, 22, 26, 27 and 30 are cross-sectional views of mechanisms containing a spouting tube, used in the present invention.
Figure 15:
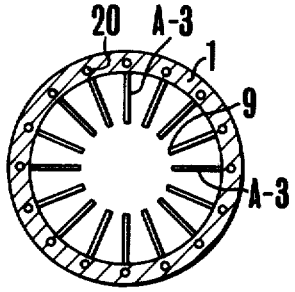
FIG. 15 is an enlarged cross-sectional view along line H—H in FIG. 14.

For example, a prismatic body A-1 polygonal in cross-section can be used as an embodiment of the projecting electricity-eliminating member A. This prismatic body A-1 may be a triangular prism as shown in FIGS. 4 and 9, a rectangular prism as shown in FIGS. 5 and 10, a triangular pyramid as shown in FIGS. 6 and 11, or preferably a long pentagonal or more polygonal prismatic body or pyramidal body. This projecting member A-1 is directly placed on the interior wall forming the flow passage 2 of the spout tube 1 longitudinally in the direction of flow of powder or fluid (indicated by an arrow 6 in the figures). It is preferred that a large number of this projecting electricity-eliminating member A be placed in the flow passage to such an extent that the members do not interrupt the flow of powder or fluid. The pyramidal member A-2 may be held in the space of the flow passage 2 by a pillar 7 fixed on the interior wall. In this case, the projecting member A can be not only pyramidal as shown in FIGS. 7 and 12 but also conical as shown in FIGS. 8 and 13. This pyramidal projecting member A-2 must be so placed that the pointed top 8 of the projecting member A-2 is opposing the flow of powder or fluid.

This prismatic body A-1 or pyramidal body A-2 may be made of materials such a as metal, electrically conductive rubber, or electrically conductive resin. It is preferable to place this prismatic body A-1 or pyramidal body A-2 in the flow passage 2 particularly, near the end of the flow passage, i.e., near the nozzle 3, because the powder or fluid passing in this area is electrically charged to the highest degree.

As another example of the projecting electricity-eliminating member A, a needle-like body or acicular body A-3 having a pointed end may be cited. This acicular body A-3 is placed on the wall forming the flow passage 10 of the spout tube 2 in such a way that pointed ends 9 radially face the flow layer of powder or fluid. This acicular body A-3 is prepared to deal with the following case: In case an electrically conductive body is electrified and the conductive body has an acute contour, a strong electric field is developed on the acute pointed end, tending to break electrostatic insulation of ambient air and also to acclerate the leakage of electric charge. Due to the above stated fact, the electric charge of an equipment main body 5 electrified in the reverse polarity, is discharged from the pointed end of an electrostatically conductive acicular body A-3 in response to the electrification of powder or fluid. This phenomenon prevents equipment under an insulated condition from becoming electrified to high voltage.

Figure 17:
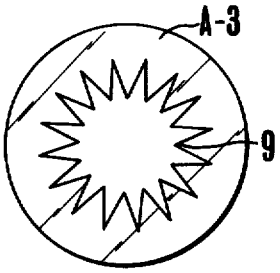
FIG. 17 illustrates one example of an acicular body composed of an electroconductive sheet.
Figure 16:
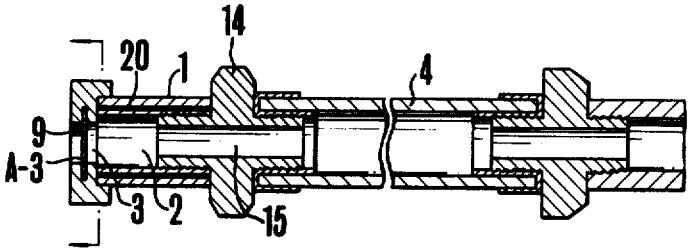

This acicular body A-3 may be made of metal, electrically conductive rubber, electrically conductive resin, etc. as is the case with the aforesaid prismatic body A-2. Also the acicular body A-3 may be made of an electrically conductive sheet which is cut into acicular shape as shown in FIGS. 16 and 17, and which is obtained by coating a flexible fiber cloth with electrically conductive rubber or resin.

It is preferable to place the acicular body A-3 in the flow passage 2 near the nozzle 3 as is the case with the prismatic body A-1 or pyramidal body A-2.

Figure 18:
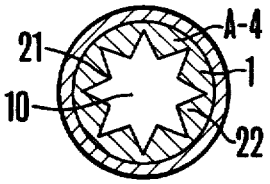
FIG. 18 is a cross-sectional view illustrating one example of a tubular body placed on the interior wall of the flow passage of a spouting tube.
Figure 19:
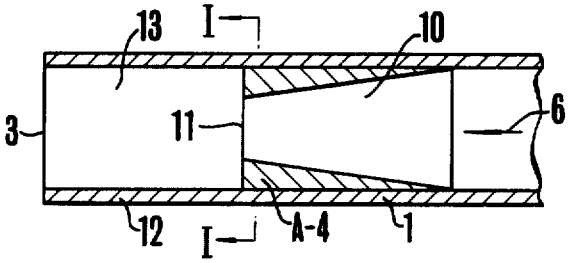

For another example of the projecting electricity-eliminating member, a tubular body A-4 having a through passage 10, whose bore is tapered from one end to the other end may be used. This tubular body A-4 is so placed in the flow passage 2, that powder or fluid flows toward the smaller bore end as shown by the arrow 6. The tubular body is so formed that the exterior outline conforms perfectly to the interior wall of the flow passage 2; accordingly, powder or fluid flowing in the flow passage 2 necessarily passes in the through passage 10. This tubular body A-4 is electrostatically connected to the equipment main body 5 charged in reverse polarity to the powder or fluid. When the powder or fluid passes in the through passage 10, it makes contact with the surface of the through passage and causes the leakage, neutralization, and discharge of electrical charge, and thereby the electricity of the equipment is eliminated. The cross-section of this through passage 10 may be either circular or polygonal, but it may be stellar. This through passage 10, whose cross-section is stellar, includes an extending ridge 22 having a sharp edge 21 in the moving direction of the powder or fluid, shown in FIG. 18, in order to increase the contact area with the powder or fluid. This contour is favorable because ionization and electrostatic neutralization phenomena of gas also result from electric discharge at the sharp edge 21 of the ridge 22.

Figure 20:
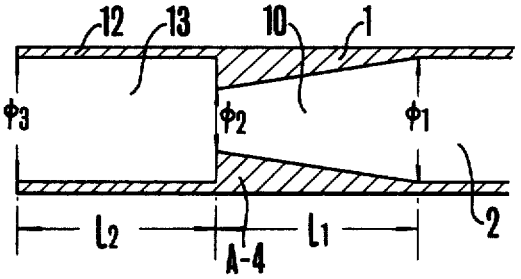

It is preferable to place the tubular body A-4 near the end or nozzle 3 of the spout tube 1, so that the moving powder or fluid contacts with the tubular body A-4 in the most intensively charged condition. The nozzle 3 may be provided with a tube end portion 12 to improve the spouting pattern of the powder or fluid. Accordingly, the tubular body A-4 can be placed in the flow passage 2 inwardly at a distance corresponding to the length of the tube end portion 12 from the nozzle 3. In this case, the portion of the spout tube 1 beyond the nozzle 3 extending to the tip of the tubular body A-4 serves as the tube end portion 12. The tubular body A-4 may be preferably made of metal, electrically conductive rubber, resin, etc. In the case where the tube end portion 12 is provided, it is desirable to satisfy the following formula determining the relationship between the bore ($\phi_3$) of the through passage 13 of the tube end portion 12, the larger bore $\phi_1$ at one end of the tubular body A-4, and the smaller bore $\phi_2$ at the other end thereof, referring to FIG. 20:

$$\phi_3 = \phi_1 \phi_2$$

Figure 21:
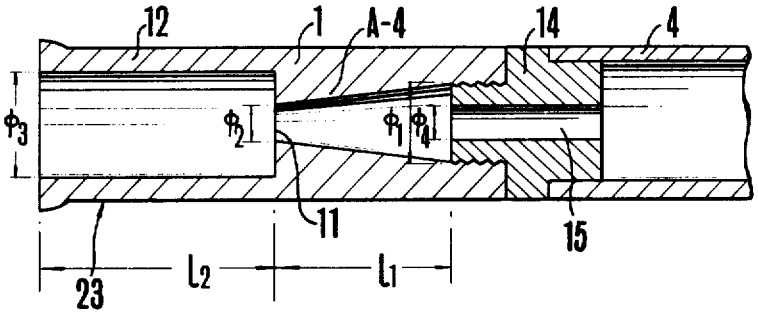

The length $l_1$ of the through passage 10 of the tubular body 14 and the length $l_2$ of the through passage 13 of the tube end portion 12 depend on the use to be made of the spouting equipment of powder or fluid. In the case of a fire extinguisher, for example, it is found that electricity is fairly well eliminated where the formula, referring to FIG. 21, is $$\phi_3 = \phi_1 \phi_2 = \phi_4 = 2 \text{ mm}$$

(where $\phi_4$ represents the bore of the through passage 15 of a connector 14 connecting the transport tube 4 with the spout tube 1), formulas $l_1 = 5$ mm and $l_2 = 10$ mm being also satisfied and the proportion of $\phi_4$, $\phi_1$, $\phi_2$, $\phi_3$, $l_1$ and $l_2$ being 1 : 2.3 : 1 : 3 : 4.7 : 6.7. The tube end portion 12 may be so formed that the volume resistivity thereof may be less than $10^8\Omega$-cm. The tube end portion 12 is electrostatically connected to the main body 5 of the equipment, and then the powder or fluid having passed the through passage 10 of the tubular body A-4 contacts with the interior wall of the through passage 13 of the tube end portion 12, and further electricity is eliminated from the powder or fluid.

Figure 22:
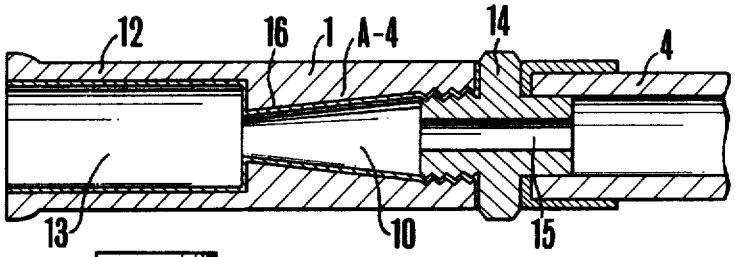

The tubular body A-4 and the spout tube 1 may be integrally formed of the same material, such as synthetic resin or rubber, by means such as injection molding. In the same manner, the tube end portion 12 and the spout tube 1 may be integrally formed of the same material. Accordingly, as shown in FIG. 21, these three parts, tubular body A-4, spout tube 1, and tube end portion 12 can be integrally made all of the same material. In case this material of the same quality exhibits volume resistivity of $10^8\Omega$-cm or less, it becomes electrically conductive as a whole. In case the volume resistivity of this material is $10^8\Omega$-cm or higher, an electrically conductive coating 16 may be formed on the interior wall of the flow passage for the powder or fluid as shown in FIG. 22. For this coating, metal plating, or a coating of conductive paint, etc. may be used with good results.

Figure 27:
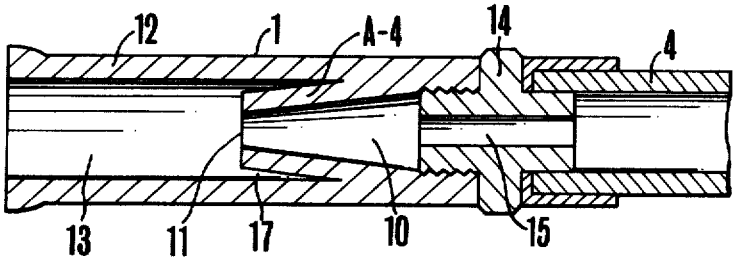

In case the tubular body A-4 and the spout tube 1 are integrally formed, a so-called "sink mark" occurs. This is a phenomenon whereby the material used shrinks particularly at the thick-wall portion after it has been formed. Accordingly, for the smaller bore end 11 of the tubular body A-4, a cut 17 is provided in the perimeter as shown in FIG. 27. It is good practice to provide a uniform wall thickness forming the through passage 10 of the tubular body A-4. The wall thickness is so uniformly formed that sink mark phenomenon is prevented.

The present invention provides equipment having a mechanism for spouting powder or fluid and is applied generally to the case where an earth wire connection is precluded due to the shape and the use of the equipment, and also to the case where an electrostatically insulated condition exists on the equipment, and to other case where a restriction is imposed for using the equipment, thereby protecting the operator from exposure to electrification.

Examples are found in a power sprayer of agricultural chemicals of the rucksack type, an agricultural chemicals sprayer for airborne use such as a helicopter, a fire extinguisher held by a man, or a flame projector. In the case where material comprising a part of the equipment, and becoming electrically charged owing to friction of powder or fluid, is electrostatically conductive, a wire of electrically conductive material such as copper wire is directly connected to this material to eliminate static electricity charged thereon. In case such a part is composed of an electrostatically insulating material such as plastic material, a film-like or wire-like substance made of electrostatically conductive material may to be wound on the part, a wire of electrostatically conductive material such as copper wire is then connected thereto, and the end of this wire is connected to an electricity removing projecting member which is directed toward the flow layer of powder or fluid. The above mentioned connections will then work well. It is difficult to substantially eliminate static electricity charged on a plastic material. However, inductive electrification takes place on the conductive material wound thereon, and if this electric charge is eliminated from the electricity removing projecting member through such phenomena as leakage or discharge of electricity, electrification apparently becomes zero. Consequently, the above mentioned methods can accomplish the intended object. It is noted that it is difficult to eliminate high voltage electricity completely to zero potential. However, a human body senses electric static potential of 3.5 – 4 KV or higher, and the present invention can eliminate electricity to lower electric potential than this level. Therefore, prevention of electric snock, the object of the present invention, is accomplished perfectly.

In the present invention, the projecting electricity-eliminating member A and the main body 5 of the equipment are electrostatically connected through a conductive material having volume resistivity of $10^8\Omega$-cm or less. The means of conduction is indicated by way of example as follows.

Figure 23:
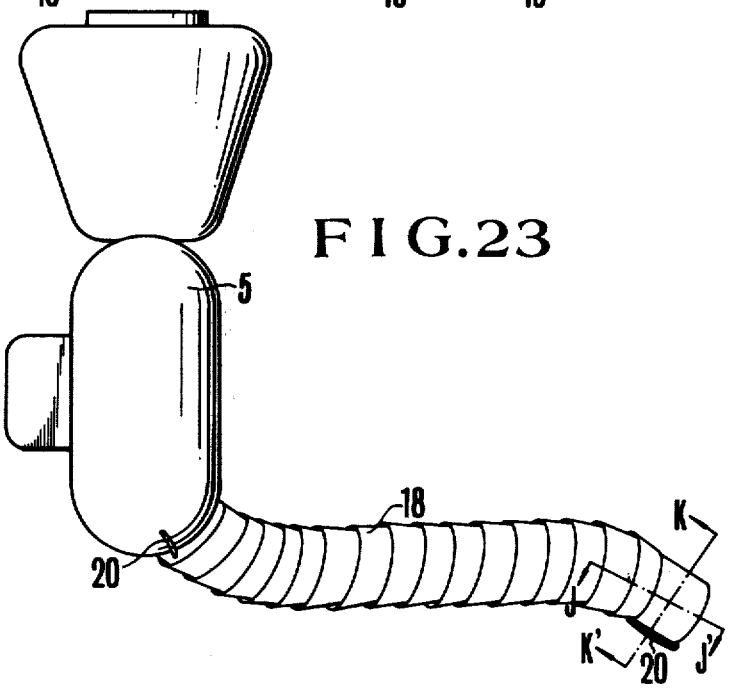
FIG. 23 is a schematic view illustrating one example of the present invention used as a power agricultural chemical sprayer of rucksack type.
Figure 24:
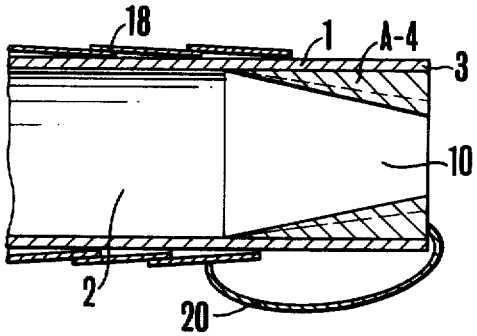
FIG. 24 is an enlarged cross-sectional view along line J—J in FIG. 23.
Figure 25:
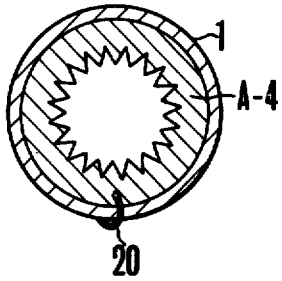
FIG. 25 is an enlarged cross-sectional view along line K—K in FIG. 23.
Figure 26:
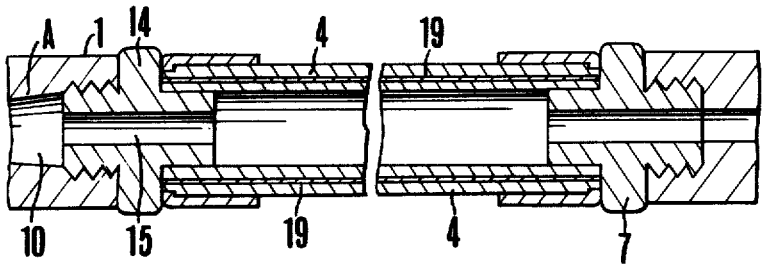

As shown in FIGS. 23, 24 and 25, in case the transport tube 4 is covered over the exterior surface with a conductive material 18 having volume resistivity of $10^8\Omega$-cm or less, the projecting electricity-eliminating member A is connected to this conductive material 18 covering the exterior surface of the transport tube 4; and by connecting the conductive material 18 to the equipment main body 5, the projecting electricity-eliminating member A is electrostatically connected to the equipment main body 5. As the electrically conductive material there is used a paint of conductive rubber or resin. Different means may be considered for this purpose. The paint may be applied to the exterior surface of the transport tube 4; the electroconductive paint may be soaked into or applied to a band-like fiber cloth; or metallic foil, metallic wire, or metallic cloth may be wound successively on the exterior surface of the transport tube 4. As shown in FIG. 26, electroconductive material 19 having volume resistivity of $10^8\Omega$-cm or less is embedded into the transport tube 4 and electrically connected through an electroconductive connector 14 to the projecting electricity-eliminating member A. The electroconductive material 19 is electrically connected to the equipment main body 5 through the electroconductive material 19, and the projecting electricity-eliminating member A is electrostatically connected to the equipment main body 5. For this electroconductive material 19 a coating of the aforesaid electroconductive paint, electroconductive fiber cloth impregnated and coated with such paint, metallic foil, metallic cloth, or metal wire may be used. If the electroconductive materials 18 and 19 are tough, the can serve for reinforcing the transport tube 4. The projecting electricity-eliminating member A may be connected to the conductive materials 18 and 19 outside or inside the transport tube 4, and the conductive materials 18 and 19 may be connected to the equipment main body 5 through an electroconductive wire 20, in addition to the aforesaid connector 14.

Further, the transport tube 4 itself may be formed of a material having volume resistivity of $10^8\Omega$-cm or less, for instance, electroconductive rubber or resin. In this case, there is no need for electroconductive material being interposed on the exterior surface or inside the transport tube 4. The projecting electricity-eliminating member A is connected directly to the transport tube 4 through a conductor 20. The transport tube 4 is connected to the equipment main body 5, through a conductor 20, and finally the projecting electricity-eliminating member A is electrostatically connected to the equipment main body. In case the connector 14 having the through passage 15 connecting the spout tube 1 to the transport tube 4 is composed of an electroconductive material having volume resistivity of $10^8\Omega$-cm or less, the projecting electricity-eliminating member A is electrostatically connected to the connector 14 through a conductor 20 or the like; as the connector 14 is connected to the transport tube 4, the projecting electricity-eliminating member A is finally connected electrostatically to the equipment main body 5. In this case, the projecting electricity-eliminating member A is electrostatically connected to the connector 14 through a conductor 20; however, projecting electricity-eliminating member A may naturally be connected electrostatically to the connector 14 through the spout tube 1, since the spout tube 1 is composed of electroconductive material having volume resistivity of $10^8\Omega$-cm or less.

In case the volume resistivity of the spout tube 1 is $10^8\Omega$-cm or less, the projecting electricity-eliminating member A is electrostatically connected to the spout tube 1, and, accordingly, the projecting electricity-eliminating member A can be electrostatically connected to the equipment main body 5 through a human body whose bare hands hold the spout tube 1 and the equipment main body 5.

EXAMPLE 1

In a marketed powder fire extinguisher of ABC type filled with 3.5 kg of powder as shown in FIG. 1, a spout nozzle made of polypropylene was replaced by a spout nozzle 23 made of a material having surface resistance of $10^3\Omega$ obtained by adding carbon powder to polypropylene resin and connected to a metallic connector 14 fixed into a nozzle of electroconductive rubber hose 4 having a surface resistance of $10^3\Omega$. The spout nozzle 23, referring to FIG. 21, had dimensions indicated as follows: $\phi_4 = 5.5$ mm, $\phi_1 = 14$ mm, $\phi_2 = 6$ mm, $\phi_3 = 18$ mm, $l_1 = 30$ mm and $l_2 = 40$ mm.

The other nozzle of the electroconductive rubber hose 4 was connected to the main body 5 of the fire extinguisher made of metal.

Accordingly the spout nozzle 23 was electrostatically connected to the main body 5 of the fire extinguisher. A person standing on an insulating expanded polystyrol board held the fire extinguisher by bare hands and spouted powdery chemicals out of it.

Figure 28:
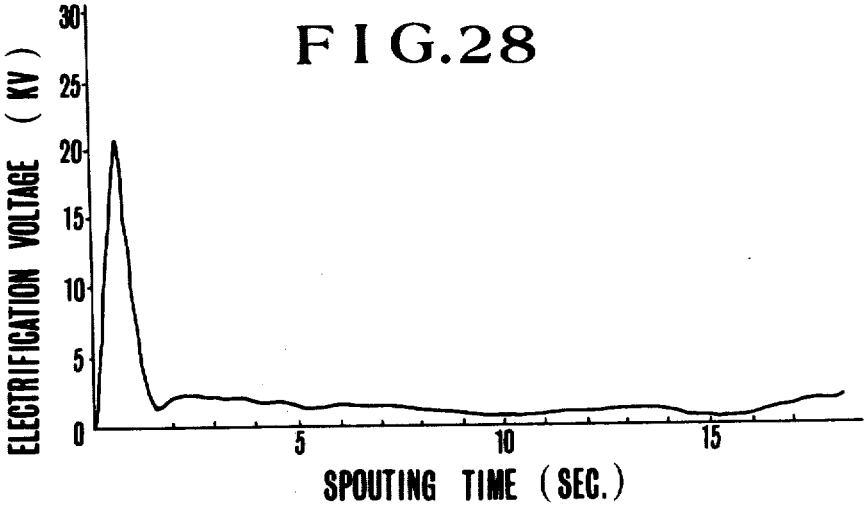
FIGS. 28, 31, 32, 33, 34 and 35 are graphs each indicating the state of electrification.

The result recording electrification on the fire extinguisher main body 5 and a human body of the person is as shown in FIG. 28. As indicated, electrification voltage became higher temporarily at the time the person started to spout chemicals, but electricity was immediately eliminated and continuously eliminated during spouting.

In such condition, this equipment produced excellent results; no electric shock was felt even though the human body touched other earthed objects. Further, since the spout nozzle 23 is provided with the tube end portion 12 at the end of the tubular body A-4, the powdery chemicals were spouted out of the end 11 of smaller bore of the tubular body A-4 in a definite direction by the tube end portion 12, displaying a good spouting pattern.

COMPARATIVE EXAMPLE 1-1

Figure 29:
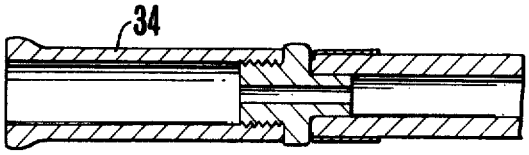
FIG. 29 is a cross-sectional view of a nozzle of a conventional fire extinguisher.
Figure 30:
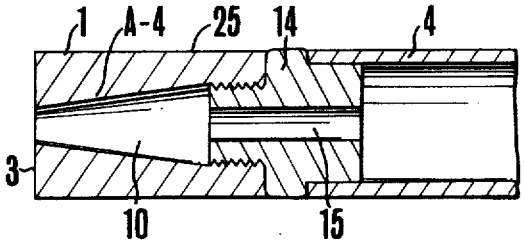
Figure 31:
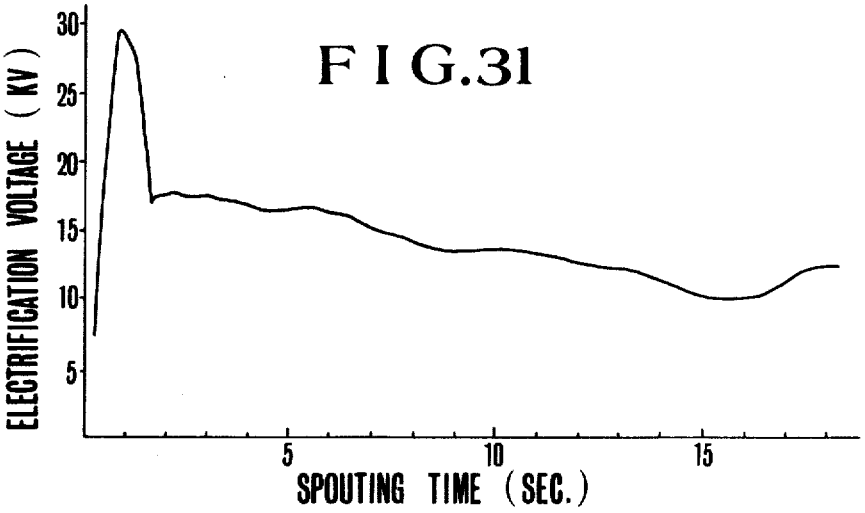

Similar spouting tests to that described in Example 1 were made on a fire extinguisher of the same marketed ABC type as used in Example 1, equipped with a conventional spout nozzle 24 made of polypropylene as shown in FIG. 29 and another fire extinguisher equipped with a nozzle 25 having only the tubular body A-4 without the tube end portion 12 as shown in FIG. 30. As a result, it was found that the fire extinguisher equipped with the conventional nozzle 24 was electrified to a high voltage as shown in FIG. 31.

Figure 32:
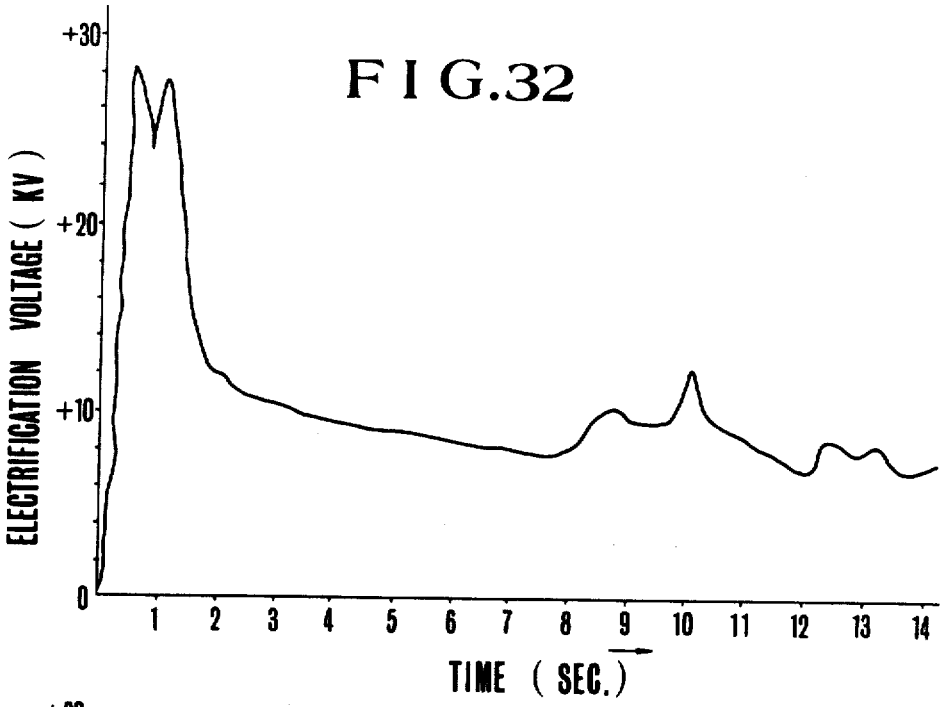
Figure 33:
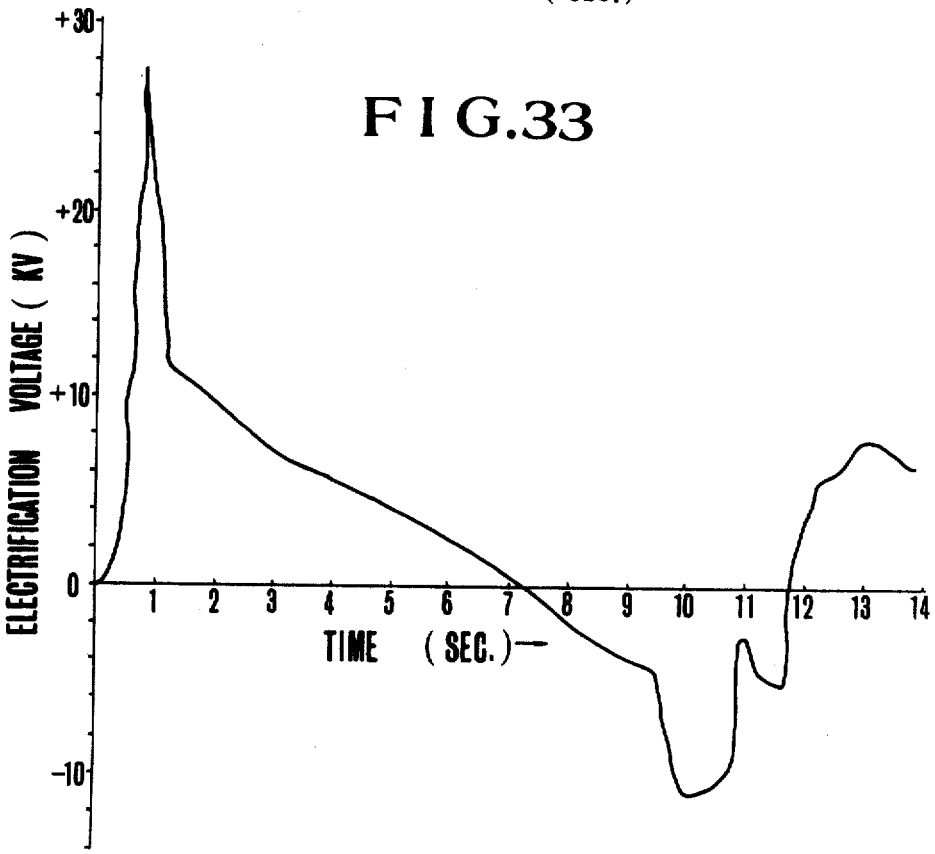

In shooting of the fire extinguisher equipped with the nozzle 25 without the tube end portion 12, the effect of eliminating electricity is shown in FIG. 32, but the indicated electrification voltage was higher than 3.5 – 4.0 KV that can be felt by the human body.

COMPARATIVE EXAMPLE 1-2

The dimensions of the nozzle shown in Example 1 were changed as follows: $\phi_4 = 55$ mm, $\phi_1 = 14$ mm, $\phi_2 = 12$ mm, $\phi_3 = 18$ mm, $l_1 = 30$ mm and $l_2 = 10$ mm. As the result of the test using this nozzle it was apparent that the removal of electricity during spouting of powdery chemicals was not sufficient. It was known from this that the contour and size proportion of the tubular body A-4 and tube end portion 12 are important factors affecting the effect of removing electricity from powder or fluid.

EXAMPLE 2

Figure 35:
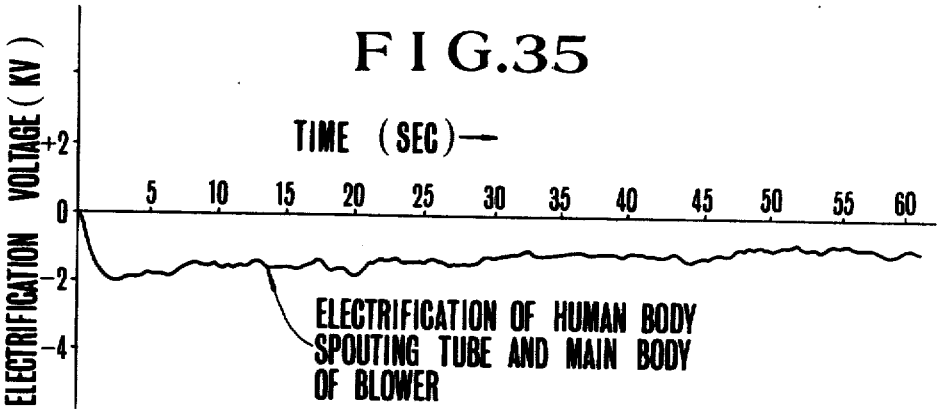

An electroconductive sheet 18 was made of a synthetic fiber cloth coated with an electroconductive paint dispersing carbon black was prepared. Then the electroconductive sheet 18 was wound on a spout pipe 1 made of vinyl chloride and it was connected to the main body 5 of a blower through a copper wire, and a tubular body A-4 made of aluminum was mounted on the interior wall of the spout pipe (I.D. 60 mm) made of vinyl chloride. The aluminum tubular body A-4 was electrostatically connected to the electroconductive sheet 18 wound on the spout pipe 1 through a copper wire 20. This sprayer was carried on an operator's back and 6 kg of powdery herbicide was spouted for test out of the sprayer by the operator standing on an insulating plastic board. FIG. 35 shows how the blower main body and the human body were electrified.

The person did not feel an electric shock even though he touched a grounded iron bar. The effect of preventing an electric shock was clearly confirmed.

COMPARATIVE EXAMPLE 2

Figure 34:
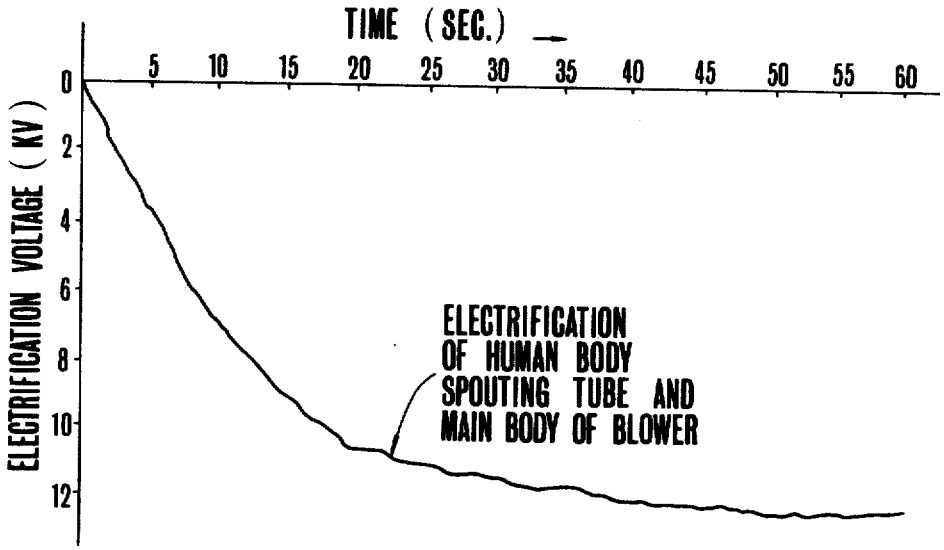

After an operator put 6 kg of powdery herbicide into a power powder sprayer of marketed rucksuck type (shown in FIG. 23), the operator stood on an insulating plastic board and spouted the powdery herbicide. FIG. 34 shows a record of how the main body of a casting blower and the human body were electrified.

The electrification voltage of the human body of the operator is equal to that of the casting blower, because the human body touched the throttle lever and adjustment lever. When the operator touched a grounded iron bar afterward, he felt a severe electric shock and a noisy discharge sound was made.

What is claimed is:

1. Apparatus for spouting powder or fluid including means for preventing operational problems caused by static electricity without grounding devices, comprising a spout tube embodying a nozzle and defining a flow passage through which said powder or fluid flows, said powder or fluid being spouted from said nozzle, a transport tube through which said powder or fluid moves to said spout tube, a main body which contains said powder or fluid and which is connected to said transport tube and a projecting electricity-eliminating member composed of a material having volume resistivity of $10^8\Omega$-cm or less, which is placed in said flow passage facing the flow layer of said flowing powder or fluid and which is electrostaticaly connected to said main body, said projecting electricity-eliminating member being configured in the form of a pyramidal body having a pointed top and arranged in the spout tube passage held by a pillar fixed on the interior wall of the spout tube, said pointed top being arranged to oppose the flow of the powder or fluid.

2. Apparatus for spouting powder or fluid including means for preventing operational problems caused by static electricity without grounding devices, comprising a spout tube embodying a nozzle and defining a flow passage through which said powder or fluid flows, said powder or fluid being spouted from said nozzle, a transport tube through which said powder or fluid moves to said spout tube, a main body which contains said powder or fluid and which is connected to said transport tube, and a projecting electricity-eliminating member composed of a material having volume resistivity of $10^8\Omega$-cm or less, which is placed in said flow passage facing the flow layer of said flowing powder or fluid and which is electrostatically connected to said main body, said projecting electricity-eliminating member being configured in the form of a tubular body having a through passage whose bore is tapered from one end to the other end and is so placed that the end of the larger bore faces toward the direction of flow of the powder or fluid, the exterior contour of the tubular body being made to coincide with the interior wall of the flow passage of the spout tube, said through passage communicating with said flow passage.

3. Apparatus according to claim 2 wherein said through passage is circular in cross-section.

4. Apparatus according to claim 2 wherein said through passage is polygonal in cross-section.

5. Apparatus according to claim 2 wherein said projecting electricity-eliminating member has volume resistivity of $10^8$ Ω-cm or less as a result of an electroconductive layer coated over the interior surface of the through passage.

6. Apparatus according to claim 2 wherein said projecting electricity-eliminating member and said spout tube are formed of the same material having volume resistivity of $10^8$ Ω-cm or less.

7. Apparatus according to claim 2 wherein said spout tube is provided with a tube end portion extending from a nozzle of the spout tube, said tube end portion having a through passage communicating with the flow passage of the spout tube and the through passage of the projecting electricity-eliminating member.

8. Apparatus according to claim 7 wherein said tube end portion and said spout tube are integrally formed of the same material having volume resistivity of $10^8$ Ω-cm or less.

9. Apparatus according to claim 2 wherein said transport tube is covered over the exterior surface thereof with an electroconductive material having volume resistivity of $10^8$ Ω-cm or less through which the projecting electricity-eliminating member is electrostatically connected to the main body of the apparatus.

10. Apparatus according to claim 2 further comprising an electroconductive material having volume resistivity of $10^8$ Ω-cm or less embedded inside a wall of the transport tube and wherein the projecting electricity-eliminating member is electrostatically connected to the main body of the equipment through said electroconductive material.

11. Apparatus according to claim 10 wherin said electroconductive material is a metallic wire.

12. Apparatus according to claim 2 wherein said transport tube is formed of an electroconductive rubber or electroconductive resin having volume resistivity of $10^8$ Ω-cm or less, said projecting electricity-eliminating member being electrostatically connected to the main body of the equipment through the transport tube.

13. Apparatus according to claim 2 wherein said spout tube and said transport tube are connected to each other through a connector having a through passage, said spout tube, transport tube, and connector being formed of an electroconductive material having volume resistivity of $10^8$ Ω-cm or less, the projecting electricity-eliminating member and the transport tube being electrostatically connected to the main body of the equipment, said projecting electricity-eliminating member being electrostatically connected to said main body through said spout tube, transport tube, and connector.

14. Apparatus according to claim 6, further comprising a cut provided on the end perimeter of the smaller bore of the projecting electricity-eliminating member, the thickness of the wall forming the through passage of the projecting electricity-eliminating member being thereby uniformly made.

15. Apparatus according to claim 7, further comprising a larger bore having a diameter $\phi_1$ at one end, a smaller bore having a diameter $\phi_2$ at the other end of the projecting electricity-eliminating member and an outlet bore having a diameter $\phi_3$ of the tube end portion, said bores being dimensioned to satisfy the formula: $\phi_3 \geqq \phi_1 > \phi_2$.

16. Apparatus according to claim 2 adapted for use as a fire extinguisher, wherein said powder or fluid consists essentially of fire extinguishing material.

17. Apparatus according to claim 15 adapted for use as a fire extinguisher wherein said spout tube is connected to said transport tube through a connector having a through passage having a bore with a diameter $\phi_4$ and wherein the following formula is satisfied:

$$\phi_3 \geqq \phi_1 > \phi_2 > \phi_4 \geqq 2 \text{ mm};$$

said through passage having a length $l_1$, of the projecting electricity-eliminating member and a length $l_2$ of the tube end portion satisfying the following formulae:

$l_1 \geqq 5$ mm; $l_2 \geqq 10$ mm; and $\phi_4 : \phi_1 : \phi_2 : \phi_3 : l_1 : l_2 = 1 : 2.3 : 1 : 3 : 4.7 : 6.7$.

18. Apparatus according to claim 2 adapted for use as an agricultural chemicals sprayer of rucksack type, wherein said powder or fluid consists essentially of agricultural chemicals.

* * * * *